US006112482A

United States Patent [19]

Wright et al.

[11] Patent Number: 6,112,482

[45] Date of Patent: Sep. 5, 2000

[54] FLOOR AND CEILING STRUCTURES

[75] Inventors: Peter Wright, West Yorkshire; Majella MacDermott Smith, North Yorkshire, both of United Kingdom

[73] Assignee: British Steel plc., London, United Kingdom

[21] Appl. No.: 09/125,034

[22] PCT Filed: Jan. 28, 1997

[86] PCT No.: PCT/GB97/00239

§ 371 Date: Aug. 11, 1998

§ 102(e) Date: Aug. 11, 1998

[87] PCT Pub. No.: WO97/30240

PCT Pub. Date: Aug. 21, 1997

[30] Foreign Application Priority Data

Feb. 15, 1996 [CA] Canada ..... 9603165

[51] Int. Cl.[7] ..... E04C 2/08

[52] U.S. Cl. ..... 52/220.4; 52/338; 52/339; 52/335; 52/798.1

[58] Field of Search ..... 52/220.4, 220.5, 52/220.6, 126.2, 793.1, 406.3, 718.1, 220, 339, 338, 335

[56] References Cited

U.S. PATENT DOCUMENTS

| | | | |
|---|---|---|---|
| 602,274 | 4/1898 | Sill | 52/339 |
| 934,939 | 9/1909 | Schlafly | 52/335 |
| 1,073,906 | 9/1913 | Kahn | 52/338 |
| 1,449,340 | 3/1923 | Menzer | 52/339 |
| 4,527,372 | 7/1985 | Ryan . | |
| 4,653,237 | 3/1987 | Taft | 52/338 X |
| 4,700,519 | 10/1987 | Person et al. | 52/338 X |
| 5,509,243 | 4/1996 | Bettigole et al. | 52/338 X |

FOREIGN PATENT DOCUMENTS

| | | | |
|---|---|---|---|
| 0 480 592 | 4/1992 | European Pat. Off. . | |
| 1093788 | 4/1954 | France | 52/339 |

*Primary Examiner*—Carl D. Friedman
*Assistant Examiner*—Phi Dieu Tran A
*Attorney, Agent, or Firm*—Blank Rome Comisky & McCauley

[57] ABSTRACT

A composite floor or ceiling structure which comprises a profiled steel deck supported by a plurality of I-section steel beams each having an upstanding web bordered by upper and lower flange plates and covered in situ with concrete. The deck comprises a plurality of side-by-side elongate profiled deck members each including an upper generally horizontal surface bordered by downwardly and outwardly inclined side surfaces. The upper flange plate of each beam has formed in its upper surface a plurality of grooves in a pattern to increase bonding between the beam and its covering of concrete. Preferably, each supporting beam is rolled as a single piece with the width of its lower flange plate greater than that of its upper flange plate to define a supporting platform for the steel deck.

5 Claims, 1 Drawing Sheet

FLOOR AND CEILING STRUCTURES

BACKGROUND OF THE INVENTION

1. Field of the Invention

This invention relates to floor and ceiling structures and more especially to composite floor and ceiling structures of concrete and steel.

2. Description of Related Art

Composite floor and ceiling structures which comprise a profiled steel deck supported on the lower flange of steel beams and covered in situ with a concrete layer are known. Advantages of such structures include reductions in floor thickness and weight, ease and speed of construction and savings in labour and cranage costs during assembly.

SUMMARY OF THE INVENTION

One problem associated with existing composite structures concern the need to ensure the adequacy of the shear bond between the concrete layer and the supporting steel beams.

It is an object of this invention to provide enhanced keying between the support beams and the concrete layer to ensure lasting connection therebetween.

It is also an object of this invention to provide improved servicing capabilities for buildings by including ducting in the steel decking and through the support beams to act as air plenums, and using the ceiling/floor structure to form either a full air-conditioning duct or as a thermally transparent surface to enhance thermal efficiency and air flow thereby reducing air-conditioning costs.

According to the present invention in one aspect, there is provided a composite floor or ceiling structure which comprises a profiled steel deck supported by a plurality of I-section steel beams each having an upstanding web bordered by upper and lower flange plates and covered in situ with concrete, the deck comprising a plurality of side-by-side elongate profiled deck members each including an upper generally horizontal surface bordered by downwardly and outwardly inclined side surfaces, the upper flange plate of each beam having formed in its upper surface a plurality of grooves in a pattern to increase bonding between the beam and its covering of concrete.

Preferably, each supporting beam is rolled as a single piece with the width of its lower flange plate greater than that of its upper flange plate to define a supporting platform for the steel deck.

Preferably the grooves of the pattern extend across the full width of the upper surface of the upper flange of each beam and are inclined to the longitudinal axis of the beam. The grooves may define a generally symmetrical diamond-shaped pattern.

Edge laps may extend outwardly from the edge of one or both inclined side surfaces of one or more deck members.

The upper surface of each deck member and/or edge lap may be formed with a dove-tail groove.

The profiled deck members may be supported at their ends on shaped diaphragms secured to the lower flange plate of the respective beam.

Concrete may be pumped, poured onto or otherwise applied to the upper surface of the steel deck and the supporting beams.

A steel anti-crack mesh may be supported by the beams and/or the steel deck before concrete is applied to the structure.

The shape of the steel deck may be such as to provide between the undersurfaces of its inclined side surfaces passageways for receiving ducting for the flow of heating and/or cooling medium, specifically air conditioning ducting. The installed floor structure may act, in use, as a heat reservoir.

The invention will now be described by way of example only with reference to the accompanying diagrammatic drawing

BRIEF DESCRIPTION OF THE FIGURES OF DRAWINGS

DETAILED DESCRIPTION OF THE PREFERRED EMBODIMENT

Figure 1:
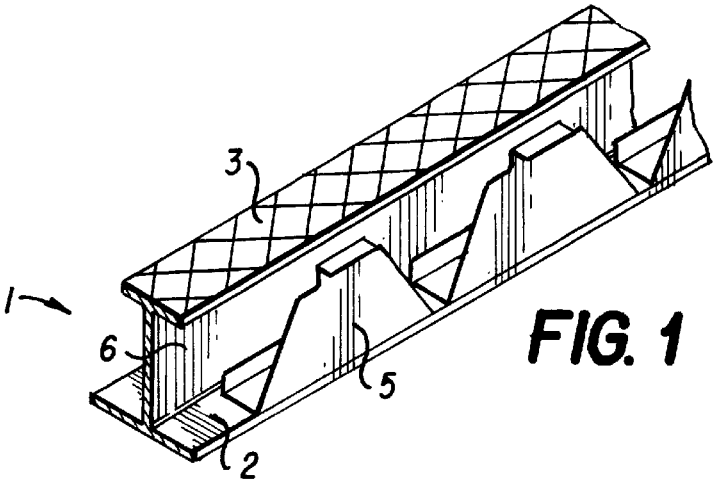
FIG. 1 is a perspective view from one side of a supporting beam of a composite structure in accordance with this invention.

As will be seen from the drawings, each support beam 1 is of asymmetrical I-section and has a lower flange plate 2 whose width is greater than that of its upper flange plate 3. This increased width enables the flange plate 2 to define a support platform for one end of a profiled steel deck 4 and steel diaphragms 5 (see FIG. 1) on which the individual deck members locate. The diaphragms 5 are secured to the flange plate 2 before the deck members are offered to the beams. Typically, the deck 4 is fixed at 600 mm centres using either shot fired pins or self drilling/tapping fasteners. The diaphragms minimise concrete leakage and provide precise alignment of the deck profile.

Each support beam 1 is rolled as a single piece with the lower and upper flange plates 2, 3 formed integrally with the central web section 6 of the beam. Preferably, the beams are formed from S355 or Fe 510 (Grade 50) steel. Alternatively, Fe 430 (Grade 43) steel may be employed especially where deflection criteria control the design.

Typical specifications of these asymmetrical beams are set out in Table A below.

TABLE A

| Section Size | Nominal Weight (kg/m) | Steel (mm) Flange | Thickness Web | Beam Span (m) | Beam Spacing (m) | Imposed Load ($kN/m^2$)† |
|---|---|---|---|---|---|---|
| 280 ASB | 100 | 16 | 19 | 6 | 6 | 5.0 |
| 280 ASB | 135 | 22 | 25 | 7.5 | 6 | 3.5 |
| or | 135 | 22 | 25 | 6 | 7.5 | 5.0 |
| 300 ASB | 150 | 24 | 27 | 7.5 | 7.5 | 3.5 |

†In addition to a partition toad of $1kN/m^2$

A pattern of groves 7 is formed in the upper surface of the upper flange plate 2 of each beam to aid keying of the concrete layer of the structure to the support beams and to produce an effective composite structure. The grooves 7 extend across the full width of the flange and define a diamond-like pattern. Typically, the depth of the grooves approximate to 1 mm to 2 mm and are the grooves are rolled into the upper surface of the upper beam flanges during production of the same.

Figure 2:
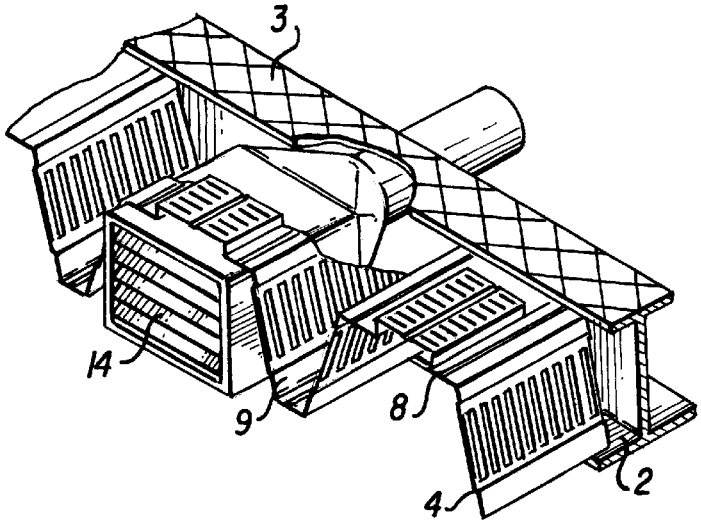
FIG. 2 is a perspective view of the supporting beam shown in FIG. 1 and steel decking of a composite structure in accordance with the invention.
Figure 3:
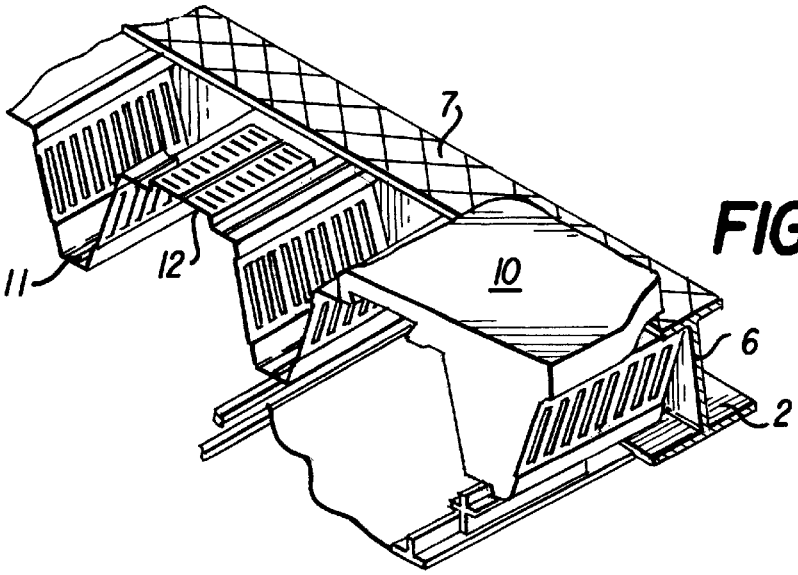
FIG. 3 is a perspective view of a composite structure in accordance with the invention partially covered with an in-situ concrete layer.

As will be seen from FIGS. 2 and 3 the steel deck 4 comprises a plurality of side-by-side elongate profiled deck members each having a ribbed upper surface 8 bordered by downwardly and outwardly extending ribbed side surfaces 9, the upper surfaces of the side surfaces 8 defining troughs for receiving concrete. The solidified concrete layer is indicated by reference numeral 10. One side surface 9 of each deck member terminates in an outwardly extending lap 11 which overlies and may be joined by, for example, stitching, to the side or an adjoining lap of the neighbouring deck member. Typically, the side laps 11 are stitched at 350 mm centres with self-drilling fasteners which also connect through shear bond clips of the deck. The individual deck members are typically of a span of up to 6 m. The upper surface 8 of each deck member includes a dovetail groove 12 to aid keying of the concrete to the decking. Each lap 11 may also include such a dovetail groove.

As will be seen from FIG. 2, holes are formed in the central wall sections of the beams to receive service ducting 14. Between the beams, this service ducting passes through three-sided conduits defined by the under surfaces of the deck upper and side surfaces 8,9. Typically, the geometry of the ribbed surfaces allows for up to 160 mm diameter or oval service openings for service runs. Typically, the holes formed in the beams are at 600 mm spacing in the middle third of the respective beam.

With the steel deck in place, a steel anti-crack mesh is supported by the beams and over the upper surface of the deck before lightweight or normal concrete 10 (see FIG. 3) is pumped or poured onto the structure completely to cover the deck and the beams, and then levelled. Reinforcement rods are provided within the troughs defined between the inclined side surfaces 9 of the individual deck members. The concrete is used primarily for stiffness to increase inertia and to provide lateral restraint to the floor at its ultimate limit state.

Typically, the floor will comprise a 60 mm or 70 mm layer of concrete covering the steel deck, with a minimum of 30 mm of this layer over the support beams 1.

The steel of the deck is preferably galvanised and is typically of 1.25 mm thickness. The ribs are typically at 600 mm centres and the depth of the deck is typically 225 mm. The deck acts as permanent formwork to the in situ concrete slab and develops composite action with the concrete.

Propping of the beams or decking is normally not necessary for the average plan grid, e.g. a 9 m beam span at 6 centres. However, for longer deck spans (up to 7.5 mm) a central line of props may be needed. If the deck is propped it is possible to achieve economies in the beam sections when construction loads dictate the design.

As will be seen from the drawings, elongate voids are defined below the steel deck between the inclined side surfaces 9 and the upper surfaces 8. These voids can, in use, be employed as ducting for conveying heated and/or cooled media to locations within the ducting in which the floor structure is installed. To this end, valves, distributors, closure floor/ceiling pieces and other necessary components can be installed such that these voids defined in the structure can be employed as distribution ducting for conditioned air, and from the ceiling finish to the compartments above or below.

The composite floor structure can also be employed as a heat reservoir. Thus, air rising through a thermally transparent ceiling below the floor structure during the day heats the concrete layer which in turn heats cooler air drawn into the building at night.

Advantages offered by floor structures in accordance with this invention include speed and ease of construction, and a lightweight structure when compared to either reinforced concrete or pre-cast structures thereby providing savings in steel and cranage costs. Also, because the deck members can arrives on-site in bundles already cut to length, they can readily be lifted into place and manhandled to form the required platform, erection can be speedily achieved. Furthermore, the deck provides a safe working platform in the construction stage and a dry working area for apparatus, and the stiffened upper surfaces of the deck members allow for flexibility in detailing of openings and vertical services. Also, when fixed, the deck acts as a diaphragm to resist in-plane forces. The structure in its entirety acts as a service plenum thereby reducing costs of service installations and operating costs for heating and cooling of the respective building.

It will be appreciated that the foregoing is merely exemplary of flooring structures in accordance with this invention and that modifications can readily be made thereto without departing from the scope of the invention as set out in the appended claims.

What is claimed is:

1. A steel and concrete composite floor or ceiling structure which comprises a profiled steel deck covered in situ on its upper surface with concrete, the structure comprising a plurality of I-section steel beams each rolled as a single piece and each having an upstanding web bordered by an upper flange plate and a lower flange plate whose width is greater than that of the upper flange plate and which defines a supporting platform for the steel deck, the profiled steel deck comprising a plurality of side-by-side elongate profiled deck members each including an upper generally horizontal surface bordered by downwardly and outwardly inclined side surfaces, an edge lap extending outwardly from the lower edge of at least one downwardly and outwardly inclined side surface of each deck member, means for connecting adjoining side laps of neighboring deck members together, the under surface of profiled deck members defining passageways for receiving service ducting, and the upper flange plate of each beam having roll-formed in its upper surface a plurality of grooves in a pattern to increase bonding between the beam and its covering of concrete;

the profiled deck members are supported at their ends on shaped diaphragms secured to the lower flange plate of the respective beam.

2. A structure as claimed in claim 1, wherein the grooves extend across the full width of the upper flange plate of each beam and are inclined to the longitudinal axis of the beam.

3. A structure as claimed in claim 1, wherein the grooves define a generally symmetrical diamond-shaped pattern.

4. A structure as claimed in claim 1, wherein the upper surface of each deck member is formed with a dove-tail groove.

5. A structure as claimed in claim 1, wherein the upper surface of each edge lap is formed with a dove-tail groove.

* * * * *